US007032554B2

(12) United States Patent
Lee

(10) Patent No.: US 7,032,554 B2
(45) Date of Patent: Apr. 25, 2006

(54) THRUST CAM CAP FOR ENGINE CAMSHAFT

(75) Inventor: Seung-Woo Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/699,174

(22) Filed: Oct. 31, 2003

(65) Prior Publication Data

US 2004/0089255 A1 May 13, 2004

(30) Foreign Application Priority Data

Oct. 31, 2002 (KR) ..... 10-2002-0066949

(51) Int. Cl.
*F01L 1/04* (2006.01)

(52) U.S. Cl. ..... 123/90.6; 123/90.34; 123/90.27

(58) Field of Classification Search ..... 123/90.6, 123/90.34, 90.27

See application file for complete search history.

(56) References Cited

U.S. PATENT DOCUMENTS 4,777,842 A * 10/1988 Yamada ..... 74/567
4,957,079 A * 9/1990 Nakatani et al. ..... 123/90.34
5,127,380 A * 7/1992 Morishita ..... 123/432
5,465,694 A * 11/1995 Agarrat ..... 123/196 R

* cited by examiner

*Primary Examiner*—Thomas Denion
*Assistant Examiner*—Zelalem Eshete
(74) *Attorney, Agent, or Firm*—Morgan Lewis & Bockius LLP

(57) ABSTRACT

The present invention provides a thrust cam cap for an engine camshaft disclosed to effectively place a thrust cam cap to limit the longitudinal movement of an engine camshaft according to the location of a thrust bearing cap that limits the longitudinal movement of the crankshaft, thereby maintaining a smooth operation of a timing belt or a timing chain in spite of thermal expansion of the crankshaft and the camshaft while an engine is in operation.

2 Claims, 3 Drawing Sheets

THRUST CAM CAP FOR ENGINE CAMSHAFT

CROSS-REFERENCE TO RELATED APPLICATIONS

This application claims priority of Korean Application No. P2002-66949, filed on Oct. 31, 2002, the disclosure of which is incorporated fully herein by reference.

FIELD OF THE INVENTION

The present invention relates to a cam cap for fixing a camshaft of an engine and, more particularly, to a thrust cam cap that limits longitudinal movement of the camshaft.

BACKGROUND OF THE INVENTION

In conventional gasoline engines, in order to fix a crankshaft in relation to the longitudinal direction of an engine, a bearing cap is typically mounted underneath a cylinder block, in comparison with a camshaft using a cam cap at a top portion of a cylinder head.

Due to tolerance, production errors, manufacturing defects, and other various factors that may occur in an engine, the crankshaft and the camshaft should not be fixed by using all bearing caps and cam caps in the longitudinal direction of an engine. Therefore, only some of the bearing caps and cam caps are allowed to have a thrust bearing structure in order to firmly restrict a certain part of the crankshaft and the camshaft.

SUMMARY OF THE INVENTION

Embodiments of the present invention provide a thrust cam cap for an engine camshaft adapted to effectively limit longitudinal movement of the engine camshaft according to the disposition of a thrust bearing cap that limits the longitudinal movement of the crankshaft. Embodiments of the present invention thus maintain smooth operation of the timing belt or a timing chain despite thermal expansion of the crankshaft and the camshaft generated while the engine is in operation.

In accordance with a preferred embodiment of the present invention, a thrust cam cap for an engine camshaft is adapted to be mounted within a region of ±5° in relation to a vertical axis, with a thrust bearing cap being the point of origin.

In an alternative embodiment, a camshaft thrust cam cap according to the present invention comprises a body member with at least one bearing part disposed thereon. The body member has two sides that define width there between and also a concave opening along one edge extending between the sides to receive the camshaft mounted on the cylinder head bearing surfaces. The bearing part is disposed along the periphery of the concave opening, forming an approximate semi-circle, on at least one side of the body part so as to protrude from that side.

Preferably, the body member defines mounting holes at opposite ends of the body member, running between the sides for securing the body member to the cylinder head with bolts, studs or the like.

BRIEF DESCRIPTION OF THE DRAWINGS

For fuller understanding of the nature and objects of the present invention, reference should be made to the following detailed description taken in conjunction with the accompanying drawings in which.

DETAILED DESCRIPTION OF THE INVENTION

A preferred embodiment of the present invention will now be described in detail with reference to the attached drawings.

Figure 1:
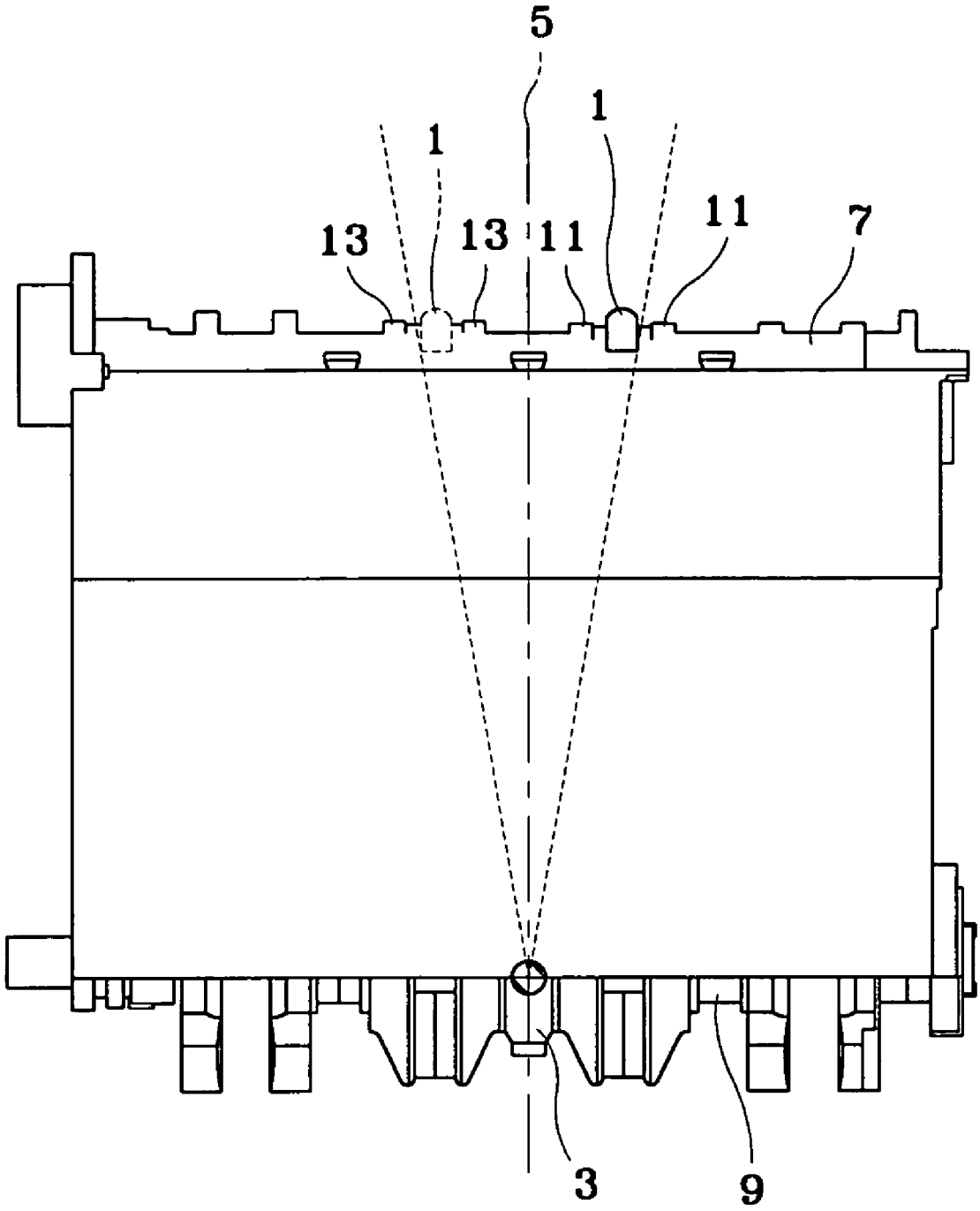
FIG. 1 illustrates installation of a thrust cam cap for an engine camshaft according to an embodiment of the present invention.

FIG. 1 illustrates a thrust cam cap 1 installed in relation to a thrust bearing cap 3 according to the present invention. Designating the thrust bearing cap 3 as the point of origin for a vertical axis 5, the thrust cam cap 1 is mounted within a region of ±5° in relation to the vertical axis 5.

If the thrust cam cap 1 is laid according to the coordinate axis described above in relation to the thrust bearing cap 3, a camshaft 7 and a crankshaft 9 expand at almost identical portions during thermal expansion. When the camshaft 7 and the crankshaft 9 have almost identical coefficients of heat expansion, the distal ends of these two experience little or no difference in length, thereby allowing a timing belt, a timing chain, the camshaft 7, and the crankshaft 9, all aligned before the engine starts to run, to be sustained at a constant level. Accordingly, the operating state of the timing belt or the timing chain can be stably maintained, thereby improving the life of an engine.

Figure 2:
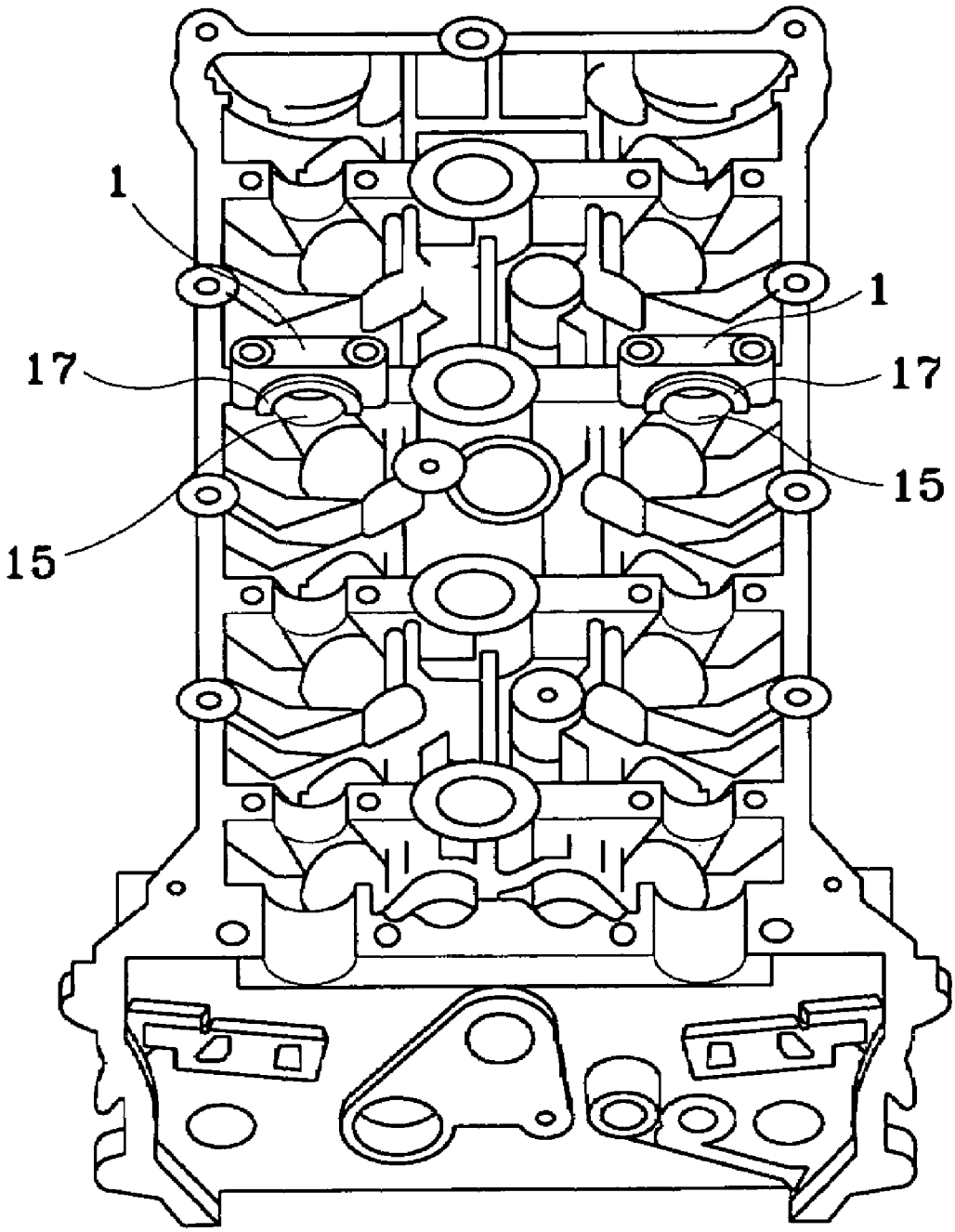
FIG. 2 is a perspective view illustrating an installation state of a thrust cam cap for an engine camshaft at a cylinder head according to the embodiment of the present invention.
Figure 3:
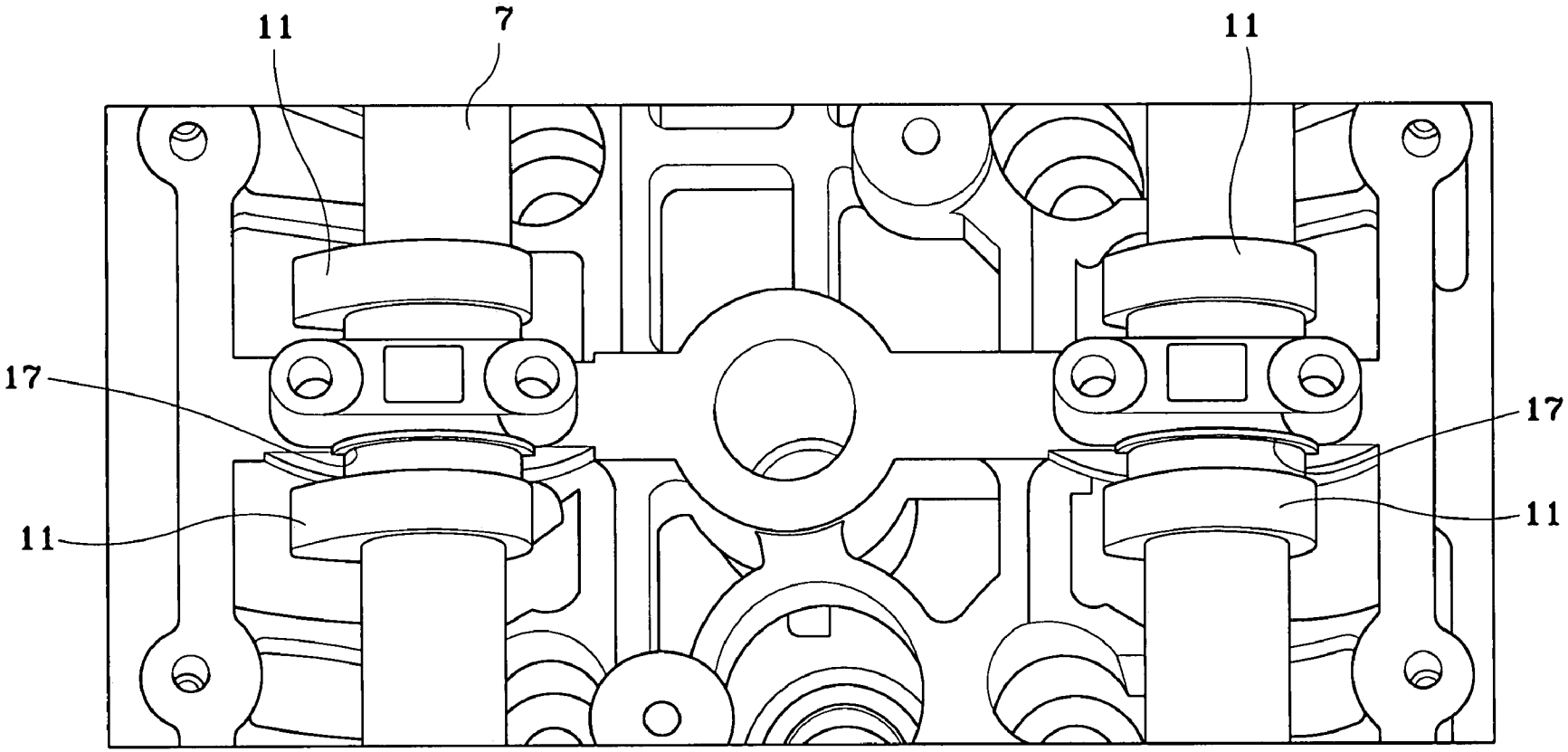
FIG. 3 is a perspective view illustrating a use state of a thrust cam cap for an engine camshaft according to the present invention.

FIGS. 2 and 3 illustrate an embodiment of the thrust cam cap 1 mounted at an engine having inline four-cylinders and sixteen-valves. The thrust bearing cap 3 (not shown in FIGS. 2 and 3) is placed between a second cylinder and a third cylinder at the bottom side of the cylinder block, while the thrust cam cap 1 is placed between the cams for second cylinder 11.

It is most preferable for the thrust cam cap 1 to be placed along a vertical axis passing through the location of the thrust bearing cap 3, but generally not possible due to interference of various components between the valve train of the cylinder head. Thus, the thrust cam cap 1 is preferably placed between the cams for second cylinder 11, as the thrust cam cap 1 can be located in closest proximity to the vertical axis, with the thrust bearing cap 3 being the point of origin.

In the same context, the thrust cam cap 1 is preferably placed between the cams for third cylinder 13, as the thrust cam cap 1 can be located in closest proximity to the vertical axis, with the thrust bearing cap 3 being the point of origin. FIG. 1 illustrates both cases of the above.

However, there is a drawback in that the thrust bearing restricting the longitudinal movement of the camshaft 7 is placed between either the cams for second cylinder 11 or the cams for third cylinder 13, thus making it difficult for a tool to be inserted therein for processing.

In order to overcome the aforementioned drawback, a bearing part 17 is formed protruding beyond the width of bearing surface 15 at a lateral side of the thrust cam cap 1 for supporting the camshaft 7 in the longitudinal direction.

Bearing part: 17 preferably extends approximately around only the upper half of the camshaft when received in thrust cam cap 1. The side of said camshaft 7 is supported by the bearing surface 15 located underneath the thrust cam cap 1.

As the lateral surface of the bearing surface 15 poses difficultly for a tool to be inserted therein for processing, it is not separately processed. A bearing part 17 which is more protrusive widthwise than the width of the bearing surface 15 is formed at the thrust cam cap 1. A thrust bearing is thus configured to restrict the longitudinal movement of the camshaft 7 at an upper semi-circular part of the camshaft 7.

As apparent from the foregoing, a thrust cam cap for an engine camshaft is disclosed to effectively place a thrust cam cap that limits the longitudinal movement of an engine camshaft according to the location of a thrust bearing cap that limiting the longitudinal movement of a crankshaft, thereby maintaining a smooth operation of a timing belt or a timing chain in spite of thermal expansion of the crankshaft and the camshaft in the course of the operation of the engine.

What is claimed is:

1. A camshaft thrust cam cap, comprising:

a body member having two sides defining a width there between and defining a concave opening along one edge extending between said sides for receiving a camshaft therein;

a bearing part disposed along a periphery of said concave opening on at least one side of said body member and protruding from said side;

wherein said camshaft thrust cam cap is mounted over a bearing surface configured to carry the camshaft; and said camshaft thrust cam cap forms a bearing part that protrudes with respect to a width of the bearing surface to support longitudinal movement of the camshaft at a lateral side of said camshaft thrust cam cap.

2. The camshaft thrust cap of claim 1, wherein said body member defines holes at opposite ends of the body member running between said sides for securing the body member to a cylinder head.

* * * * *